US007543341B1

(12) United States Patent
Carbaugh

(10) Patent No.: US 7,543,341 B1
(45) Date of Patent: Jun. 9, 2009

(54) PATIENT TRANSFER DEVICE

(76) Inventor: Richard F. Carbaugh, 1402 Lady Amber La., Granbury, TX (US) 76049

( * ) Notice: Subject to any disclaimer, the term of this patent is extended or adjusted under 35 U.S.C. 154(b) by 191 days.

(21) Appl. No.: 11/546,844

(22) Filed: Oct. 11, 2006

Related U.S. Application Data

(60) Provisional application No. 60/820,779, filed on Jul. 29, 2006.

(51) Int. Cl.
*A61G 7/053* (2006.01)

(52) U.S. Cl. ..... 5/81.1 RP; 5/662

(58) Field of Classification Search ..... 5/81.1 R, 5/81.1 RP, 86.1, 662
See application file for complete search history.

(56) References Cited

U.S. PATENT DOCUMENTS 4,829,612 A * 5/1989 Adams ..... 5/81.1 RP
5,079,789 A * 1/1992 Jandrakovic ..... 5/81.1 RP
5,311,622 A * 5/1994 Allen ..... 5/81.1 RP
5,507,044 A * 4/1996 Williamson et al. ..... 5/81.1 RP
5,524,303 A * 6/1996 Palmer et al. ..... 5/81.1 RP
6,058,527 A * 5/2000 Charpin ..... 5/81.1 RP
6,119,287 A * 9/2000 Phillips ..... 5/81.1 RP

* cited by examiner

*Primary Examiner*—Michael Trettel
(74) *Attorney, Agent, or Firm*—Stratton Ballew PLLC

(57) ABSTRACT

A patient transfer device for facilitating the movement of physically impaired patients from one location to an adjacent location. The device includes a base plate and a patient support plate. The patient support plate rotates with respect to the base plate to enable the transfer of an impaired patient from one location to an adjacent location or from one position to another. A foot restraining device is provided to hold the patient's feet in place on the patient support plate. A knee support structure is provided for supporting the weight of the patient as the transfer takes place.

13 Claims, 9 Drawing Sheets

PATIENT TRANSFER DEVICE

CROSS REFERENCE TO RELATED APPLICATIONS

This application claims priority of co-pending provisional patent application Ser. No. 60/820,779, filed Jul. 29, 2006.

BACKGROUND OF THE INVENTION

The present invention relates to medical devices that assist physically impaired patients, and more specifically relates to a device for facilitating movement of the patient from one location to an adjacent location, for example, from a car to a wheelchair or from a wheelchair to a bed.

There have been many inventions to assist the movement of physically impaired patients. Among these inventions are assorted transfer devices. Many of these transfer devices are designed to transport impaired patients across distances.

The prior art discloses several transfer devices that are designed to transfer physically impaired individuals. For example: U.S. Pat. Nos. 5,381,569; 5,507,044; 6,058,527 and 6,119,287.

Despite the ingenuity of the foregoing devices, there remains a need for a transfer device or stand which is portable, lightweight, sturdy and able to accommodate larger adults. In addition, the device should be usable in tight or limited spaces, simple to operate, impose minimal physical stress on the assistant, and impose minimal mental and physical stress on the physically impaired patient.

BRIEF DESCRIPTION OF THE INVENTION

The present invention is directed to a portable, lightweight and sturdy transfer device for impaired patients. The device includes a base plate and a patient support plate. The patient support plate rotates with respect to the base plate to enable the transfer of an impaired patient from one location to an adjacent location or from one position to another. The invention further comprises a foot restraining device to hold the patient's feet in place on the patient support plate for those patients not able to keep their feet steady. In an embodiment, the invention includes a knee support structure.

This portable patient transfer device is designed to be used with an assistant during the transfer of the physically impaired patient. The device is designed to minimize the physical strain on the assistant and the mental and physical strain on the patient during transfer.

DETAILED DESCRIPTION OF THE PREFERRED EMBODIMENTS

Figure 1:
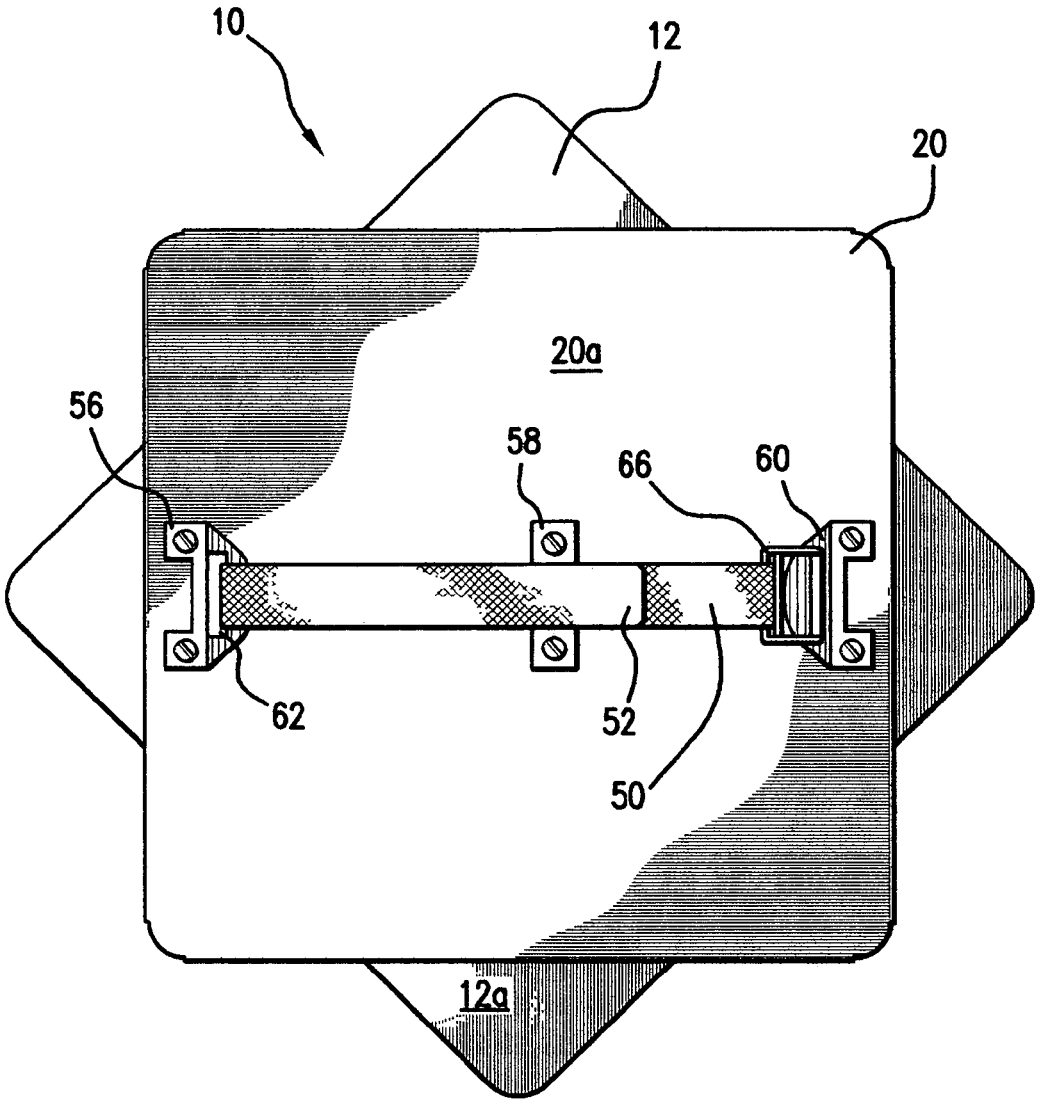
FIG. 1 is a plan view of the claimed invention, showing the patient support plate in a rotated position relative to the base plate.
Figure 2:
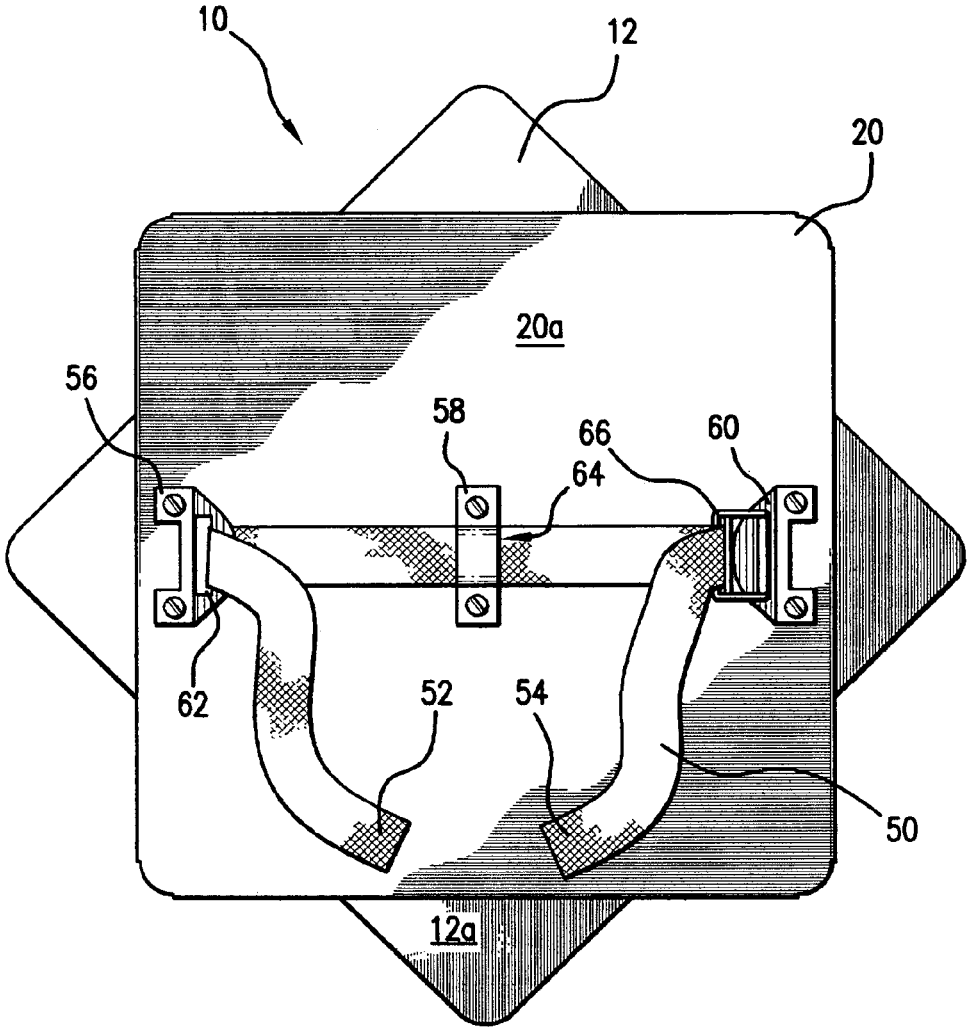
FIG. 2 is a plan view of the claimed invention, showing the patient support plate in a rotated position relative to the base plate, and showing detail of the foot restraining device.
Figure 3:
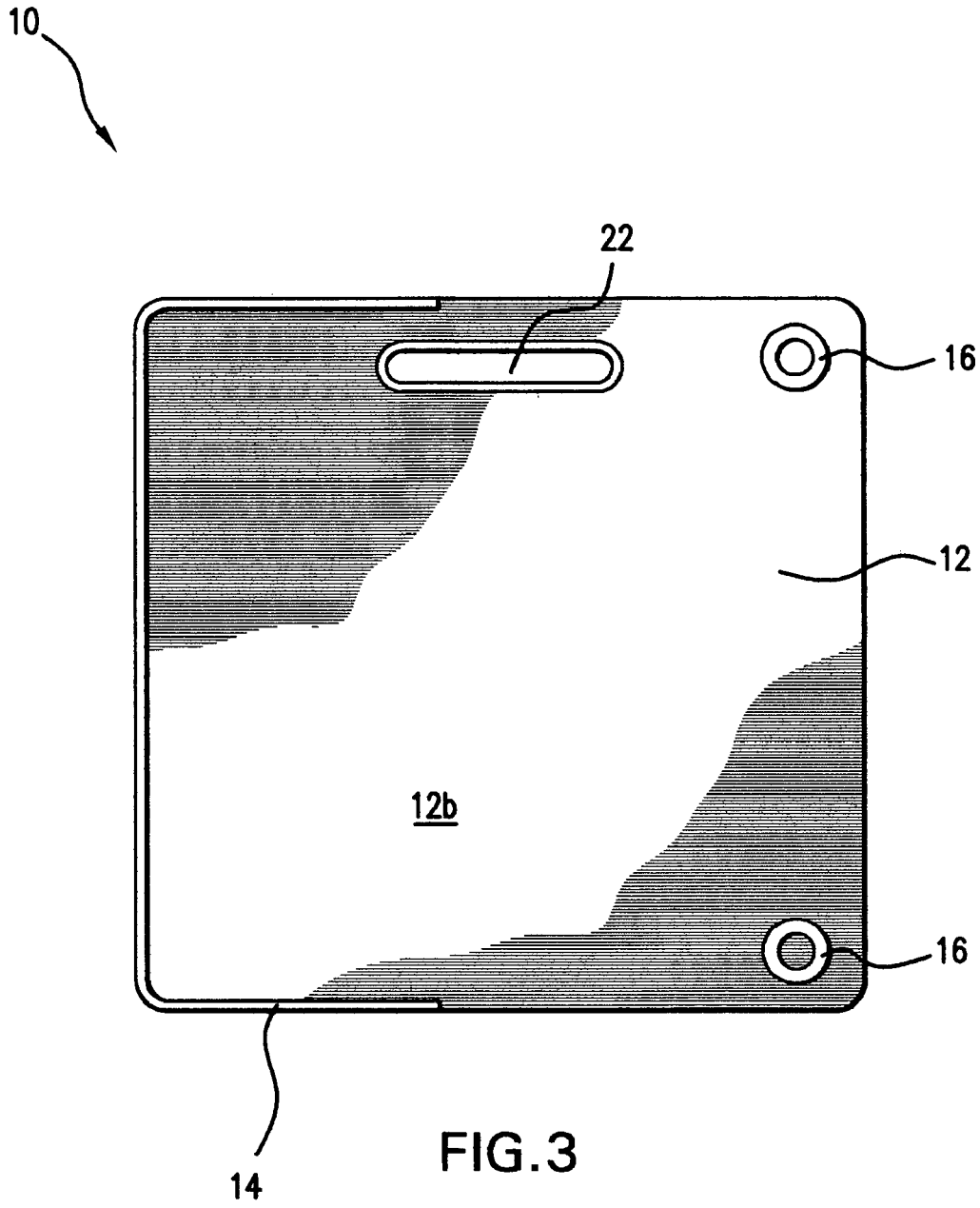
FIG. 3 is a plan view of the claimed invention, showing the lower surface of the base plate.
Figure 4:
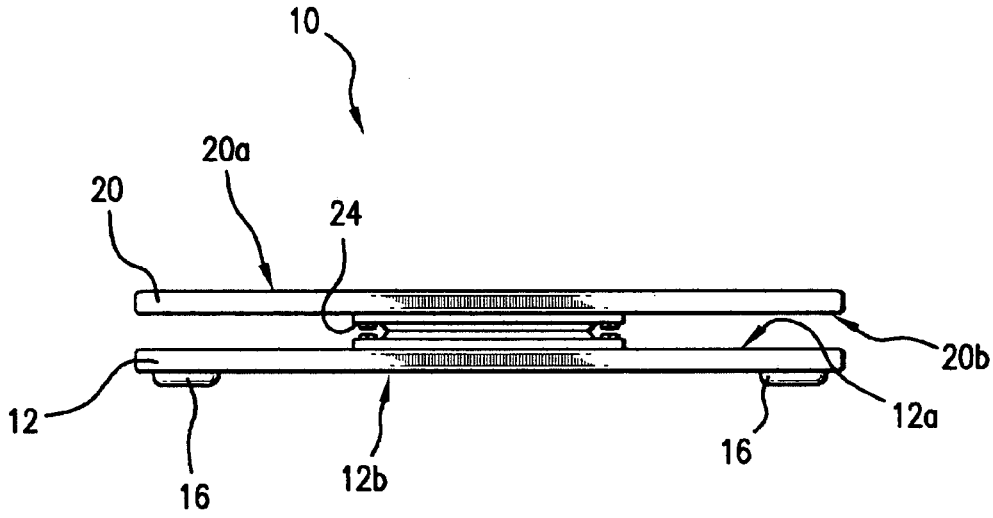
FIG. 4 is a side view of the claimed invention, showing the patient support plate, the base plate and the swivel mechanism.
Figure 5:
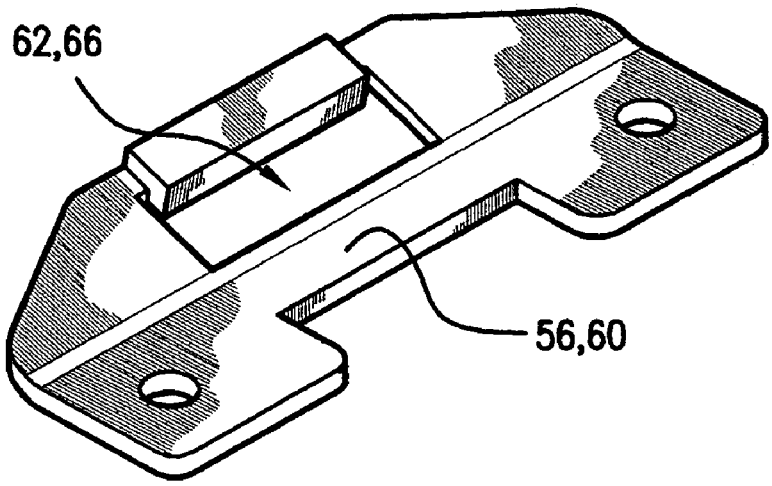
FIG. 5 is a perspective view of a side strap bracket of the claimed invention.
Figure 6:
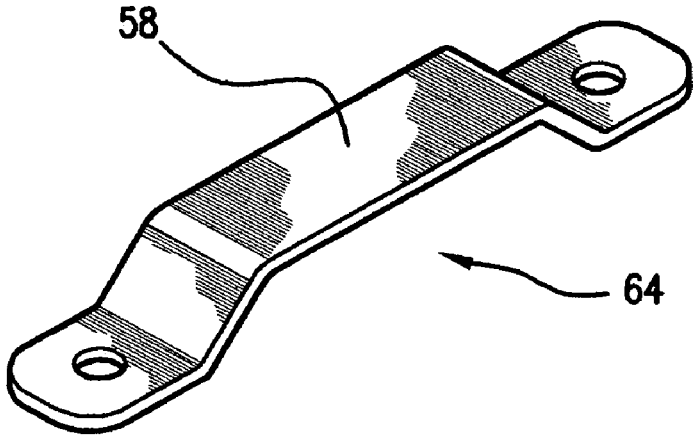
FIG. 6 is a perspective view of a center strap bracket of the claimed invention.

The patient transfer device of the present invention comprises a rotating base and a foot restraining device. The rotating base 10 includes a base plate 12, as shown in FIGS. 1 through 4. In use, the base plate is positioned on the floor or ground. The base plate includes a base plate upper surface 12*a* and a base plate lower surface 12*b*. Non-slip devices such as non-skid trim 14 (FIG. 3), feet 16 (FIGS. 3 and 4), or non-skid coating (not shown) may be provided on the lower surface of the base plate to prevent the base plate from sliding when in use.

The rotating base 10 further includes a patient support plate 20. The patient support plate comprises a patient support plate upper surface 20*a* and a patient support plate lower surface 20*b*.

In an embodiment, an aperture 22 is defined in the base plate, forming a handle by which to move and carry the rotating base.

The base plate 12 and the patient support plate 20 are rotatably joined by a swivel mechanism 24. A 7" industrial swivel with 51 ball bearings, manufactured by Trendler, Inc., has been used by the inventor for the swivel mechanism. The swivel mechanism is attached to the lower surface 20*b* of the patient support plate and the upper surface 12*a* of the base plate. The patient support plate is rotatable with respect to the base plate over 360 degrees range of motion by means of the swivel mechanism.

The patient transfer device further comprises a foot restraining device to hold the patient's feet in place on the patient support plate 20. In an embodiment, a foot restraining strap 50 is provided on the patient support plate upper surface 20*a*. The foot restraining strap has a first end 52 and a second end 54, and is preferably made from a conformable, flexible material such as fabric or webbing, and preferably includes hook and loop fastener or other suitable fastener to allow the strap to be secured in a desired position. The foot restraining strap is secured to the patient support plate upper surface 20*a* with a first side strap bracket 56, a center strap bracket 58, and a second side strap bracket 60. In use, the foot restraining strap is passed through an aperture 62 formed by or in the first side strap bracket, then through an aperture 64 formed by or in the center strap bracket, and finally through a loop 66 in, or an aperture formed by or in, the second side strap bracket. The first end and the second end of the foot restraining strap are then secured together at the desired position using the selected fastener.

The patient transfer device may further comprise a knee support structure 100, as shown in FIGS. 7 through 10. In this embodiment, the rotating base may be somewhat larger, to accommodate the knee support structure. An 11" industrial swivel with 81 ball bearings, manufactured by Trendler, Inc., has been used by the inventor for the swivel mechanism 24 in this embodiment. The knee support structure provides additional support for patients who are unable to lock their knees in a standing position. If a patient is unable to lock his or her knees, it is substantially more difficult for an assistant to transfer the patient, because the assistant must bear most of the patient's weight during the transfer. The knee support structure is particularly useful when the assistant or caregiver is smaller in stature than the patient, or when the assistant or caregiver has insufficient strength to support the body weight of the patient while making the transfer. The knee support structure provides a framework upon which weight of the patient may rest, taking strain off of the assistant, and allowing the assistant to guide, rather than lift, the patient.

Figure 7:
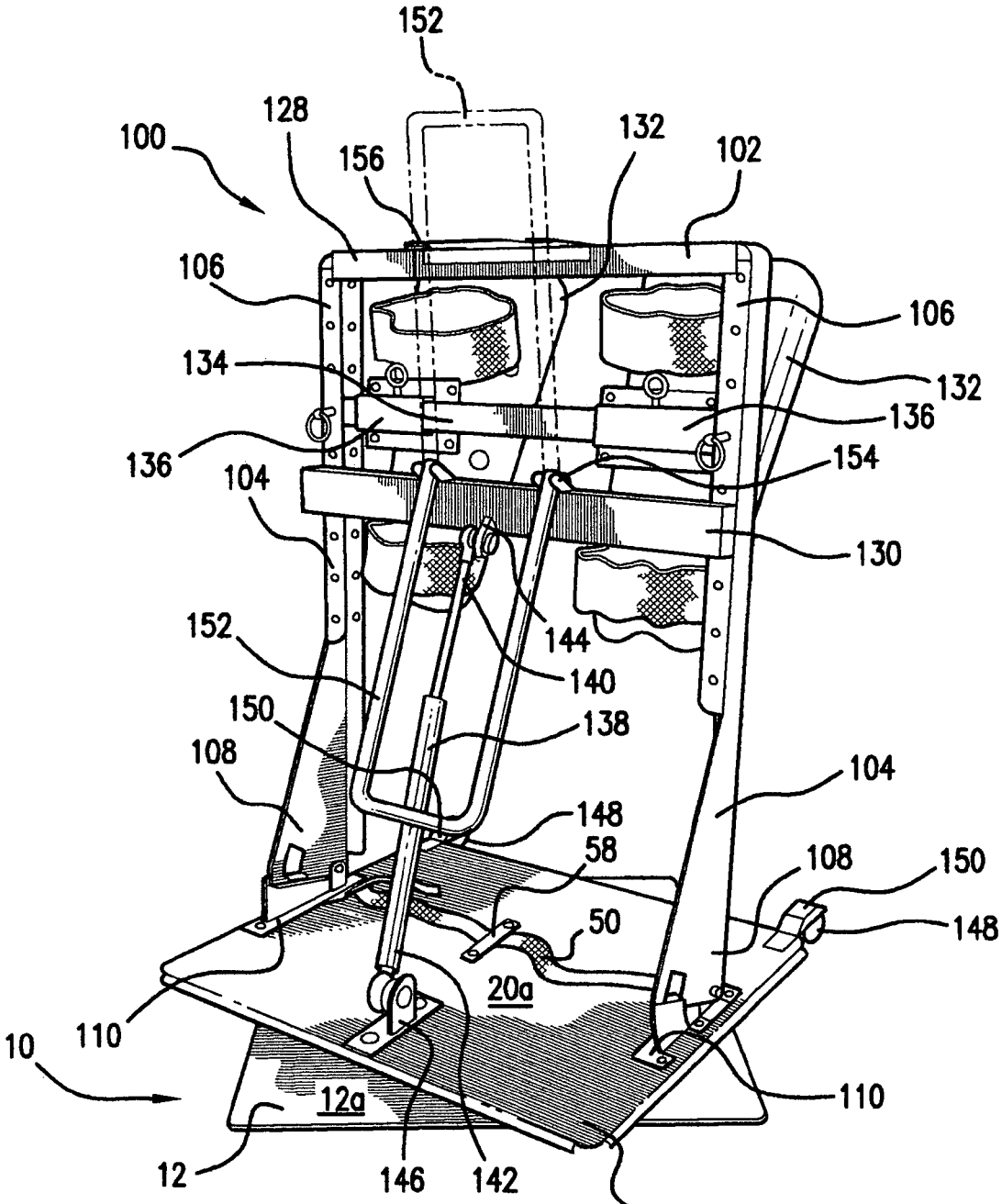
FIG. 7 is a perspective view of the claimed invention, showing the knee support structure.
Figure 8:
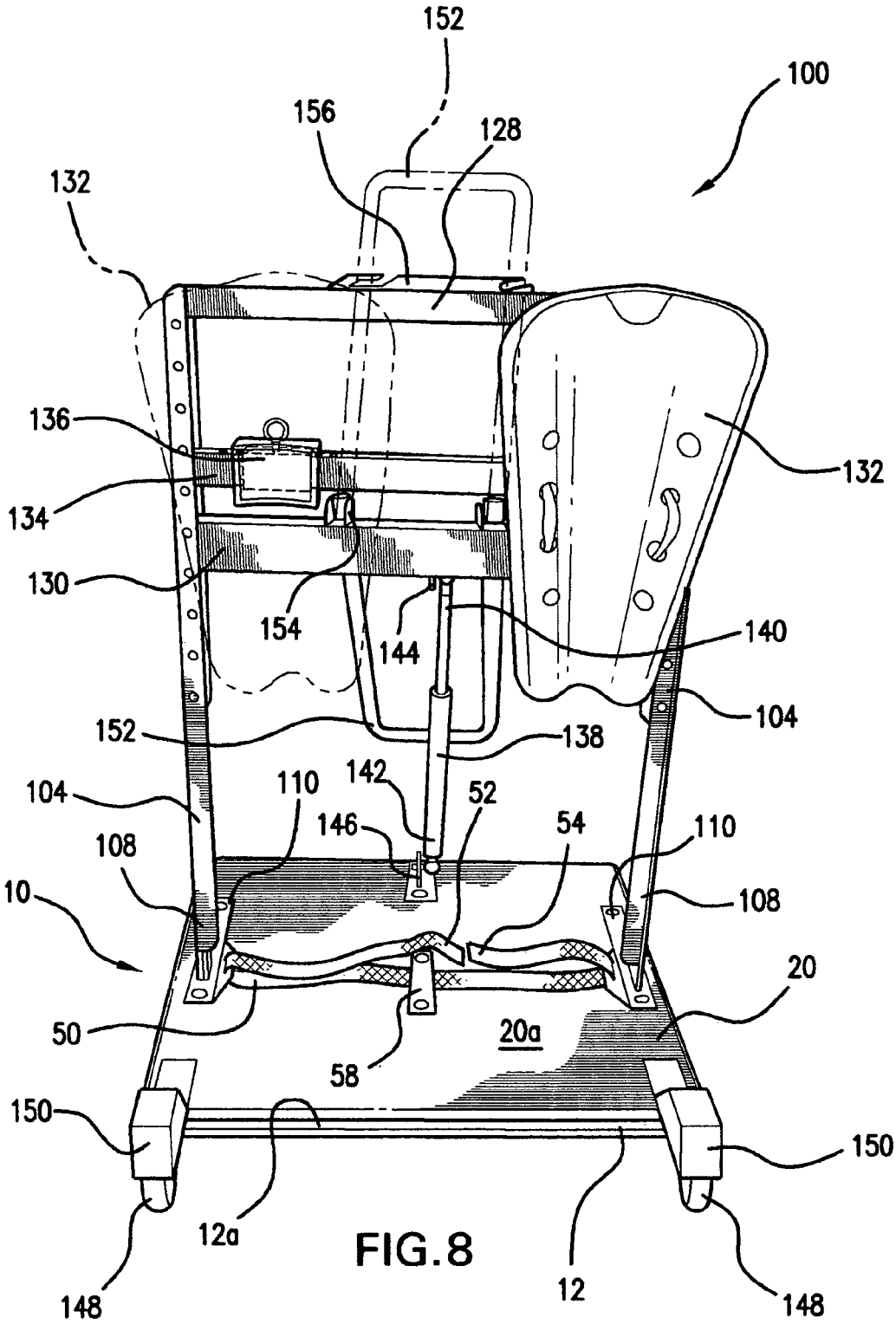
FIG. 8 is a perspective view of the claimed invention, showing the knee support structure.
Figure 9:
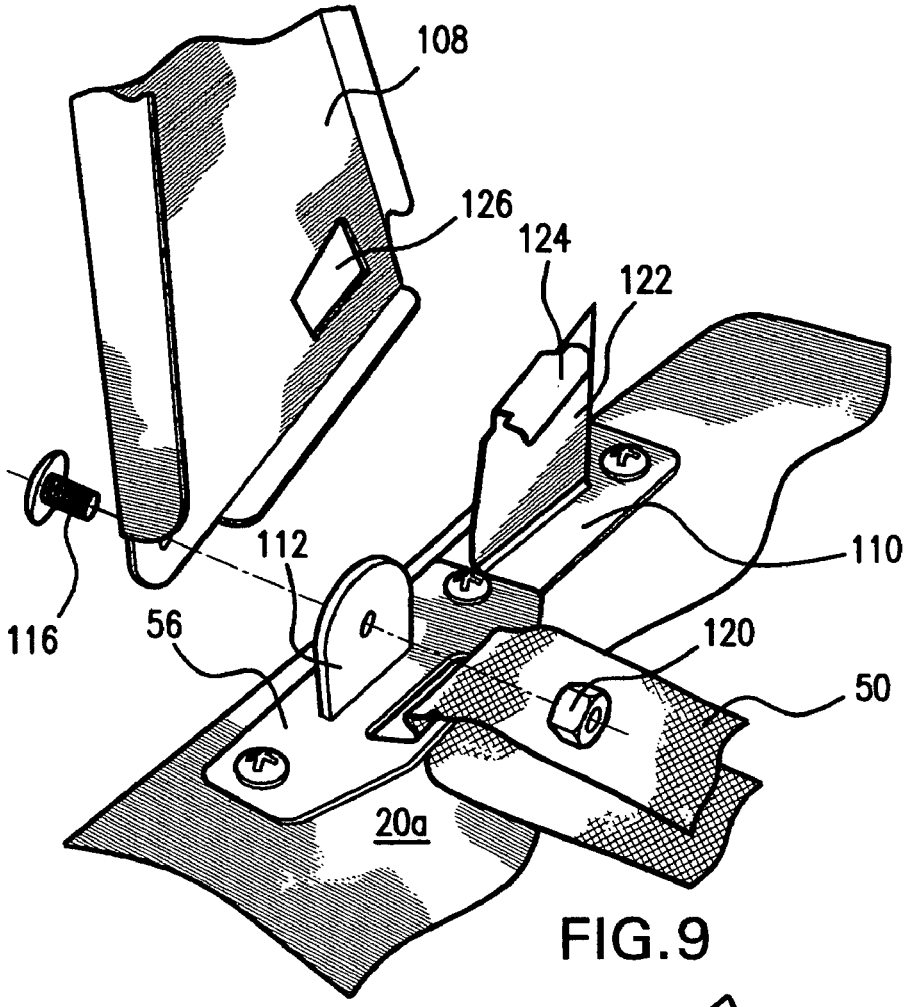
FIG. 9 is an exploded perspective view of the claimed invention, showing the support frame mounting bracket.
Figure 10:
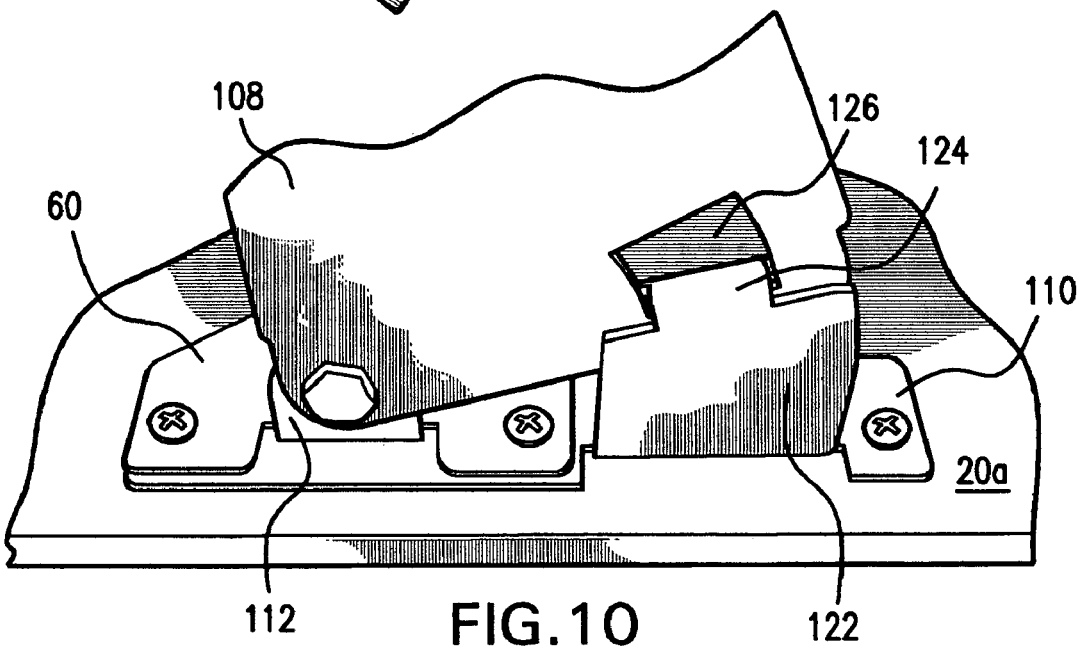
FIG. 10 is a perspective view of the claimed invention, showing the support frame mounting bracket.
Figure 11:
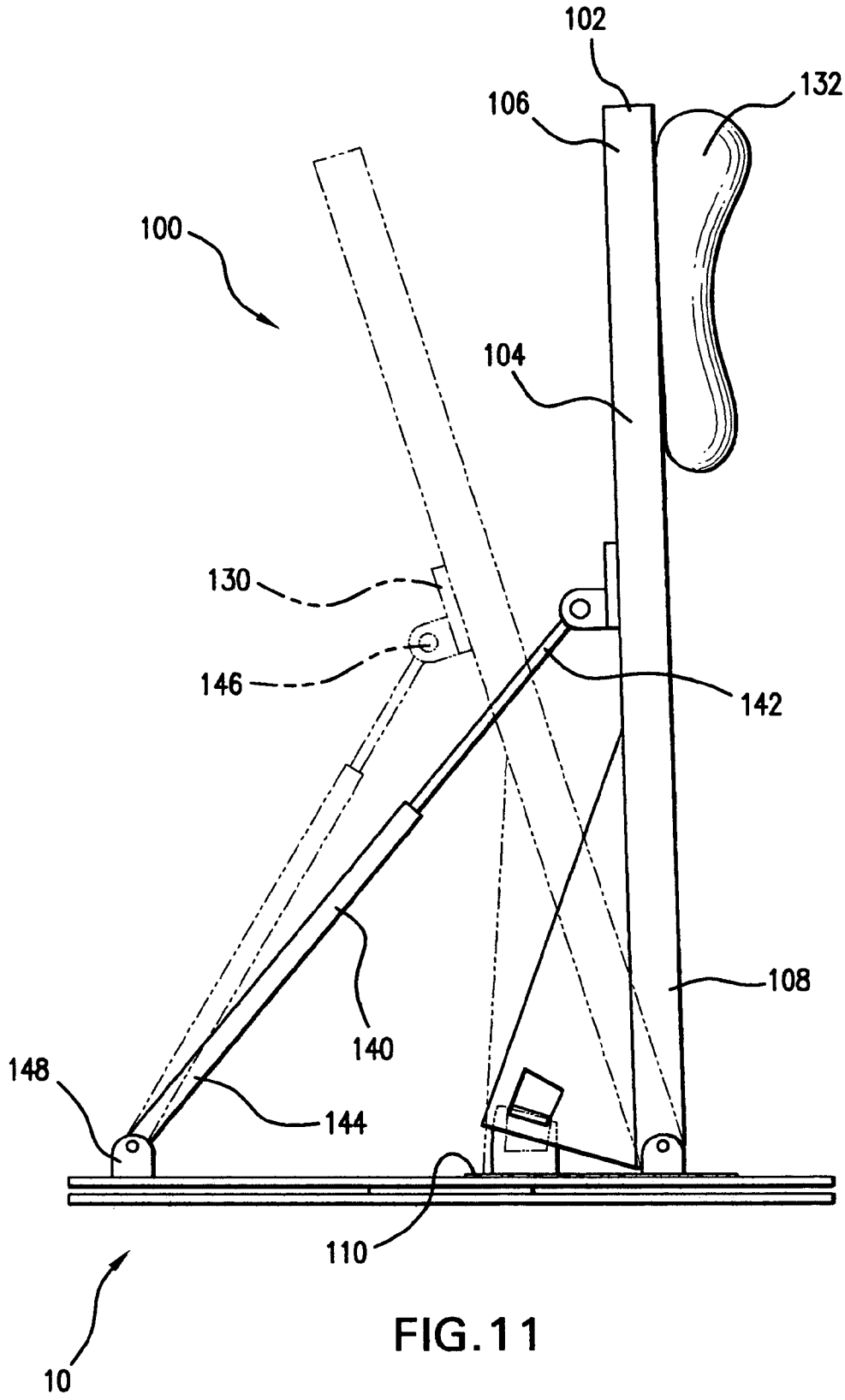
FIG. 11 is a side view of the claimed invention, showing the knee support structure.

The knee support structure 100 includes a pivoting support frame 102, which is pivotable between a substantially vertical position and an inclined position, as shown in FIG. 11. The pivoting support frame includes two upright support members 104. Each upright support member has an upper end 106 and a lower end 108. In an embodiment, the upper end of each upright support member is U-shaped in cross section, and may include one or more pin receiving apertures along its length. The lower end of the upright support member forms a planar, generally triangular surface, as shown in FIGS. 7 and 8. The upright support member is configured to be pivotably secured to the patient support plate 20. A support frame mounting bracket 110 is secured to the patient support plate to pivotably receive the pivoting support frame. In an embodiment, the support frame mounting bracket comprises a pivot flange 112 extending substantially perpendicularly from the patient support plate. The pivot flange includes a pivot flange pin aperture 114 for receiving a pivot pin 116. The lower end of the upright support member includes a corresponding support member pivot pin aperture 118, concentric with the pivot flange pin aperture, for receiving the pivot pin. In the embodiment shown in the drawings, the pivot pin is a bolt secured in place by a nut 120.

The support frame mounting bracket 110 further includes at least one guide flange 122 for guiding and aligning the lower end of the upright support member as the upright support member pivots in relation the to the pivot flange. In a preferred embodiment, a delimiting tab 124 extends perpendicularly from the top edge of the guide flange and is adapted to be received in a corresponding aperture 126 in the lower end 108 of the upright support member 104. The delimiting tab constrains the pivoting movement of the pivoting support frame with respect to the mounting bracket 110.

In the embodiment shown in FIGS. 7 and 8, the pivoting support frame 102 includes two upright support members 104, spaced apart from one another. In the preferred embodiment, the pivoting support frame includes a substantially horizontal cross member 128, which joins the upright support members at their upper ends 106. The support frame may be further stabilized by one or more secondary cross members 130.

The knee support structure 100 further includes at least one knee pad 132, as shown in FIGS. 7 and 8. In the preferred embodiment shown in the drawings, the knee support structure includes two knee pads. Each knee pad is affixed to the pivoting support frame 102. The pivoting support frame may include a knee pad attachment rail 134, which extends substantially horizontally between and affixed to the upright support members 104. Preferably, the knee pad attachment rail is adjustably secured to the upright support members, such that the rail may be raised or lowered to accommodate patients of various heights. Each knee pad may be securely affixed to the knee pad attachment rail, or it may be removably affixed to a knee pad attachment bracket 136, as shown in the drawings. In this embodiment, hook and loop fastener is used to removably affix the knee pads to the knee pad attachment brackets. Each knee pad attachment bracket is securely affixed to the knee pad attachment rail. Alternatively, the knee pad attachment brackets may be adjustably affixed to the knee pad attachment rail, so that the position of the brackets on the rail can be laterally adjusted to suit the needs of the patient. Knee pads such as those manufactured by Century, Inc., item number 11773, have been used successfully with this embodiment.

At least one support strut 138 is secured to the patient support plate 20 and the pivoting support frame 102. A 60 psi gas shock, McMaster item number 4138T56, has been used successfully as a support strut. Alternatively, two 30 psi gas shocks may be used. The support strut includes a first end 140 and a second end 142. The first end of the support strut is pivotably secured to a first strut bracket 144 mounted on the pivoting support frame, preferably on secondary cross member 130. The second end of the support strut is pivotably secured to a second strut bracket 146 mounted on the upper surface 20*a* of the patient support plate. When the support strut is in an extended position, the pivoting support frame is substantially vertical. As force is applied to the knee pads 132 mounted on the pivoting support frame, the support strut compresses and the pivoting support frame tilts toward the support strut. Preferably, the pivoting support frame pivots approximately 15 degrees from its starting position.

The patient transfer device of the present invention is portable. For the embodiment including only the rotating base, a handle is provided in the form of an aperture 22 defined in the base plate 12. In the embodiment that includes the knee support structure 100, additional means are provided for moving and repositioning the device. Wheels 148 are mounted in wheel brackets 150 on an edge of the patient support plate 20. The wheel brackets are positioned so that when the patient transfer device is in use, the wheels do not touch the ground or interfere with the swiveling movement of the patient support plate. When the patient transfer device is being moved or repositioned, it can be tilted so that the wheels touch the ground. A handle 152 is provided for tilting the patient transfer device and pushing, pulling or turning it to a desired position. In the preferred embodiment shown in FIGS. 7 and 8, the handle is pivotably mounted on secondary cross member 130 by handle mounting bracket 154. A handle receiving bracket 156 is slidably affixed to the cross member 128 to receive and removably secure the handle. In use, the handle is pivoted to a substantially vertical position parallel to the upright support members 104. The handle receiving bracket is then slid into position to receive the handle and retain it in position while the patient transfer device is moved or repositioned. Alternatively (not shown), the handle 152 may be mounted to crossmember 128.

The patient transfer device of the present invention is intended to be used by an assistant in transferring a patient from an initial location (Position A) to a destination location (Position B). In use, the patient transfer device 10 is placed on the floor or ground in front of the patient to be transferred, in Position A. The patient's feet are positioned on the patient support plate upper surface 20*a*. When using a foot restraining device, a first foot is positioned between the first side strap bracket 56 and the center strap bracket 58. A second foot is positioned between the center strap bracket and the second side strap bracket 60. The foot restraining strap 50 is arranged so that it passes through the aperture 62 in the first side strap bracket, over the first foot, through the aperture 64 in the center strap bracket, over the second foot, and through the aperture 66 in the second side strap bracket. The patient's foot or feet are secured in place by removing any slack in the foot restraining strap, and securing the first end 52 and the second end 54 of the foot restraining strap. In an embodiment, the first end is secured to the second end with hook and loop fastener material. When the foot restraining strap is tightened and secured, the patient's feet are restrained from sliding on the upper surface 20*a* of the patient support plate 20. The presence of a non-slip surface on the patient support plate upper surface aids in restraining the patient's foot or feet in position.

Once the patient's feet are in position on the patient support plate, the assistant raises, or assists the patient in rising, to a standing position and holds the patient upright in Position A. The assistant then rotates the patient to Position B. The patient support plate 20 rotates with the patient, while the base plate 12 remains in its original position. Once the patient is properly aligned in Position B, the assistant lowers, or assists in lowering, the patient into the desired position. Once the transfer is complete, the patient's foot or feet are released from the foot restraining strap 50 by releasing the fastener securing the strap first end 52 to the strap second end 54.

When using the patient transfer device with a knee support structure 100, the process is as described above, with the following additional steps. As necessary, the knee pad height and horizontal position are adjusted prior to moving the patient. As the patient is raised to a standing position as described above, the assistant positions the patient's knees on the knee pads 132, and allows the patient's knees to bend slightly so that the patient's weight shifts to the knees. As the patient's weight shifts, the pivoting support frame 102 of the knee support structure 100 pivots forward with the support strut 138 and the delimiting tabs 124 controlling and limiting the movement of the pivoting support frame. In this position, the patient's weight is supported by the knee support structure rather than by the assistant. The transfer to Position B is then continued as described above. As the patient is lowered into the desired position, the support strut returns to an extended position, and the pivoting support frame is restored to a substantially vertical position.

In compliance with the statutes, the invention has been described in language more or less specific as to structural features and process steps. While this invention can be embodied in different forms, the specification describes and illustrates preferred embodiments of the invention. It will be understood that this disclosure is an exemplification of the principles of the invention, and is not intended to limit the invention to the particular embodiments described. Those with ordinary skill in the art will appreciate that other embodiments and variations of the invention, which employ the same inventive concepts as the invention, are possible. Therefore, the invention is not to be limited except by the following claims, as appropriately interpreted in accordance with the doctrine of equivalents.

I claim:

1. A patient transfer device comprising a rotating base, the rotating base comprising: a base plate having an upper surface and a lower surface; a substantially planar patient support plate having an upper surface and a lower surface; and a swivel mechanism secured between the base plate upper surface and the patient support plate lower surface for allowing rotational movement of the patient support plate with respect to the base plate, and a foot restraining device secured to the patient support plate upper surface, the foot restraining device comprising a first side strap bracket positioned on a first side of the patient support plate upper surface, a second side strap bracket positioned on a second side of the patient support plate upper surface opposite the first side strap bracket, a center strap bracket positioned substantially between the first side strap bracket and the second side strap bracket, and a root restraining strap having a first end and a second end, wherein the strap passes through apertures in the first side strap bracket, the center strap bracket, and the second side strap bracket, and is held in place by a fastener for adjustably securing the strap first end to the strap second end.

2. The patient transfer device of claim 1, wherein the fastener for adjustably securing the strap first end to the strap second end is hook and loop fastener.

3. The patient transfer device of claim 1, wherein the base plate lower surface includes a non-slip device for preventing the base plate from sliding when in use.

4. The patient transfer device of claim 1, further comprising a knee support structure, the knee support structure comprising:

a pivoting support frame pivotably secured to the patient support plate, wherein the pivoting support frame is pivotable between a substantially vertical position and an inclined position; and at least one knee pad secured to the pivoting support frame.

5. The patient transfer device of claim 4, wherein the pivoting support frame includes two upright support members spaced apart from one another, and a substantially horizontal cross member.

6. The patient transfer device of claim 5, wherein the pivoting support frame further comprises a knee pad attachment rail, the knee pad attachment rail extending substantially horizontally between and affixed to the upright support members, and wherein the knee pad is affixed to the knee pad attachment rail.

7. The patient transfer device of claim 4, wherein the pivoting support frame includes at least one support strut, the support strut having a first end and a second end, the first end of the support strut secured to the pivoting support frame, and the second end of the support strut secured to the patient support plate upper surface; and, the pivoting support frame is supported in the substantially vertical position when the support strut is extended, and the pivoting support frame is in an inclined position when the support strut is compressed.

8. The patient transfer device of claim 7, wherein the pivoting support frame includes a secondary cross member extending horizontally between the upright support members, and the first end of the support strut is pivotably secured to the secondary cross member.

9. A patient transfer device comprising:

a rotating base, the rotating base comprising a base plate having an upper surface and a lower surface, a substantially planar patient support plate having an upper surface and a lower surface, and a swivel mechanism secured between the base plate upper surface and the patient support plate lower surface for allowing rotational movement of the patient support plate with respect to the base plate; and a knee support structure, the knee support structure comprising a pivoting support frame pivotably secured to the patient support plate, wherein the pivoting support frame comprises two upright support members spaced apart from one another and at least one substantially horizontal cross member extending between the upright support members, and wherein the pivoting support frame is pivotable between a substantially vertical position and an inclined position, and at least one knee pad secured to the pivoting support frame.

10. The patient transfer device of claim 9, further comprising:

a support strut for supporting the pivoting support frame in a substantially vertical position, wherein a first end of the support strut is pivotably secured to a horizontal cross member of the pivoting support frame, and a second end of the support strut is pivotably secured to the upper surface of the patient support plate.

11. The patient transfer device of claim 9, wherein:

the pivoting support frame further comprises a knee pad attachment rail extending substantially horizontally between and adjustably affixed to the upright support members, and the knee pad is affixed to the knee pad attachment rail.

12. A method for transferring a patient from an initial location to a destination location, the method comprising the steps of:

positioning a patient transfer device directly in front of the patient in the initial location, the patient transfer device comprising a base plate having an upper surface and a lower surface, a substantially planar patient support plate having an upper surface and a lower surface, and a swivel mechanism secured between the base plate upper surface and the patient support plate lower surface for allowing rotational movement of the patient support plate with respect to the base plate, and a foot restraining device secured to the patient support plate upper surface, the foot restraining device comprising a first side strap bracket positioned on a first side of the patient support plate upper surface, a second side strap bracket positioned on a second side of the patient support plate upper surface opposite the first side strap bracket, a center strap bracket positioned substantially between the first side strap bracket and the second side strap bracket, and a foot restraining strap having a first end and a second end, wherein the strap passes through apertures in the first side strap bracket, the center strap bracket, and the second side strap bracket and is held in place by a fastener adjustably securing the strap first end to the strap second end;

positioning the patient's feet on the upper surface of the patient support plate; securing the patient's feet in position with the foot restraining device by placing a first foot between the first side strap bracket and the center strap bracket; placing a second foot between the center strap bracket and the second side strap bracket; positioning the foot restraining strap so that it passes through the first side strap bracket, over the first foot through the center strap bracket, over the second foot, and through the second side bracket; pulling the foot restraining strap snug over the first foot and the second foot; and fastening the strap first end to the strap second end to secure the patient's feet in position;

raising the patient to a standing position;

while supporting the patient in a standing position, rotating the patient to the destination location;

lowering the patient to the desired position at the destination location; and releasing the patient's feet from the foot restraining device by releasing the fastener securing the strap first end to the strap second end.

13. The method of claim 12, wherein the patient transfer device further comprises a knee support structure, the knee support structure comprising a pivoting support frame pivotably secured to the patient support plate. wherein the pivoting support frame is pivotable between a substantially vertical position and an inclined position, and at least one knee pad secured to the pivoting support frame, and wherein the step of raising the patient to a standing position further comprises the steps of:

positioning the patient's knees on the knee pads; and allowing the patient's knees to bend slightly so that the patient's weight shifts to the knees.

* * * * *